US005878914A

United States Patent [19]

Johnson

[11] Patent Number: 5,878,914

[45] Date of Patent: Mar. 9, 1999

[54] TOY WATER GUN

[75] Inventor: Lonnie G. Johnson, Smyrna, Ga.

[73] Assignee: Johnson Research & Development Company, Inc., Smyrna, Ga.

[21] Appl. No.: 778,865

[22] Filed: Jan. 2, 1997

Related U.S. Application Data

[63] Continuation-in-part of Ser. No. 402,624, Mar. 13, 1995.

[51] Int. Cl.[6] ..... A63H 3/18

[52] U.S. Cl. ..... 222/79; 222/212; 222/401

[58] Field of Search ..... 222/207, 209, 222/212, 340, 79, 386.5, 387, 401, 386, 444; 446/473

[56] References Cited

U.S. PATENT DOCUMENTS

| | | | |
|---|---|---|---|
| D. 78,206 | 4/1929 | Hermann . | |
| D. 159,040 | 7/1950 | Bicos | D30/1 |
| D. 265,221 | 6/1982 | Hardin | D21/147 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/147 |
| D. 338,697 | 8/1993 | Salmon et al. | D21/147 |
| D. 340,750 | 10/1993 | Salmon et al. | D21/147 |
| D. 341,174 | 11/1993 | Salmon et al. | D21/147 |
| 1,964,345 | 7/1934 | Feller . | |
| 2,049,194 | 7/1936 | Chapin | 43/147 |
| 2,303,510 | 12/1942 | Swebilius | 42/69 |
| 3,197,070 | 7/1965 | Pearl | 222/79 |
| 3,273,553 | 9/1966 | Doyle | 124/3 |
| 3,794,789 | 2/1974 | Bynum | 200/83 Z |
| 4,022,350 | 5/1977 | Amron | 222/790 |
| 4,160,513 | 7/1979 | Cockerman | 222/181 |
| 4,214,674 | 7/1980 | Jones et al. | 222/79 |
| 4,441,629 | 4/1984 | Mackal | 222/324 |
| 4,509,659 | 4/1985 | Cloutier et al. | 222/41 |
| 4,591,071 | 5/1986 | Johnson | 222/39 |
| 4,706,848 | 11/1987 | D'Andrade | 222/79 |
| 4,743,030 | 5/1988 | Auer et al. | 273/349 |
| 4,750,641 | 6/1988 | Hun | 222/798 |
| 4,757,946 | 7/1988 | Johnson | 239/99 |
| 4,854,480 | 8/1989 | Shindo | 222/210 |
| 4,875,508 | 10/1989 | Burke et al. | 141/2 |
| 4,955,512 | 9/1990 | Sharples | 222/386.5 |
| 5,029,732 | 7/1991 | Wong | 222/79 |
| 5,074,437 | 12/1991 | D'Andrade | 222/79 |
| 5,150,819 | 9/1992 | Johnson et al. | 222/79 |
| 5,155,310 | 10/1992 | Goans | 200/82 |
| 5,184,755 | 2/1993 | Brovelli | 222/79 |
| 5,184,756 | 2/1993 | Amron | 222/79 |
| 5,229,531 | 7/1993 | Song | 42/58 |
| 5,238,149 | 8/1993 | Johnson et al. | 222/79 |
| 5,244,153 | 9/1993 | Kuhn et al. | 239/587.5 |
| 5,339,987 | 8/1994 | D'Andrade | 222/79 |
| 5,360,142 | 11/1994 | Stern et al. | 222/79 |

FOREIGN PATENT DOCUMENTS 28875 12/1910 United Kingdom .

*Primary Examiner*—Philippe Derakshani
*Attorney, Agent, or Firm*—Kennedy, Davis & Kennedy

[57] ABSTRACT

A water gun (10) is provided having a storage tank (18), a expandable pressure tank (19) having an elastic bladder (30) encased within an outer shell (29), and a pump (32) for conveying liquid from the storage tank to the expandable pressure tank. The conveyance of liquid into the expandable pressure tank causes the liquid to be pressurized by the biasing force of the elastic bladder. The pressurized liquid is released through a nozzle (21) coupled to the expandable pressure tank by actuation of a trigger (17). The storage tank may be collapsible to prevent the storage of air therein or be coupled to a fluid selective check valve to prevent air from being pumped into the pressure tank.

22 Claims, 4 Drawing Sheets

TOY WATER GUN

REFERENCE TO RELATED APPLICATION

This is a continuation-in-part of application Ser. No. 08/402,624 filed Mar. 13, 1995.

TECHNICAL FIELD

This invention relates to toy water guns, and specifically to water guns having an expandable pressure tank.

BACKGROUND OF THE INVENTION

Water guns which eject a stream of water have been a very popular toy for children. These guns have been designed to eject the stream of water in a number of ways. The most common method of ejecting water has been by a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which creates single, short bursts of water. However, many children desire the production of an extended stream of water.

Water guns have also been designed with small electric pumps which expel a stream of water from a tube coupled to the pump, as shown in U.S. Pat. Nos. 4,706,848 and 4,743,030. However, these small electric pumps typically cannot eject the stream of water a lengthy distance.

Toy water guns have also been developed which eject a stream of water by exerting pressure on the water within the gun greater than that of ambience and controlling the release of water through a control valve. The water is expelled from the gun due to this pressure difference. The pressurization of the water has been achieved in a variety of manners. U.S. Pat. No. 3,197,070 illustrates a water gun wherein pressure is applied to the water by collapsing a water storage area. Similarly, U.S. Pat. No. 4,854,480 illustrates a water gun wherein water is forced into an elastic bladder which expands to maintain the water under pressure. The presence of air within the storage area is a problem, as a portion of the elastic force of the bladder inherently is used to compress the air rather than pressurizing the water. This use of the elastic force of the bladder is inefficient.

Lastly, water guns have been designed with manual pumps which force water or air from a storage reservoir to a pressure reservoir, as shown in U.S. Pat. No. 5,150,819. The conveyance of the water or air into the pressure tank compresses the air therein, thereby exerting pressure on the water within the storage tank. However, as water is released from the pressure tank the volume occupied by the air increases. This increase in volume causes the air pressure within the pressure tank to decrease rapidly, thus resulting in a decrease in water pressure and a weaker projected water stream. Another potential problem associated with this type of water gun is that since the pressure tank is typically constructed of a hard plastic, the accidental striking of the pressure tank may cause it to crack or rupture. This problem is even more likely to occur when the interior of the plastic pressure tank is stressed under high pressure.

Accordingly, it is seen that a need remains for a water gun which can generate a long, steady stream of water and which is not easily ruptured. It is to the provision of such therefore that the present invention is primarily directed.

SUMMARY OF THE INVENTION

In a preferred form of the invention a water gun comprises a storage reservoir adapted to hold a range of liquid quantities and constructed to prevent air from being held therein, and an expandable pressure tank adapted to hold liquid and to expand upon depositing liquid therein so as to exert a force upon the liquid. The water gun also has a pump for drawing liquid from the storage reservoir and depositing the drawn liquid into the expandable pressure tank. Conduit means are included for conveying liquid from the expandable pressure tank to ambience and control means for controlling the flow of liquid therethrough.

DETAILED DESCRIPTION

Figure 1:
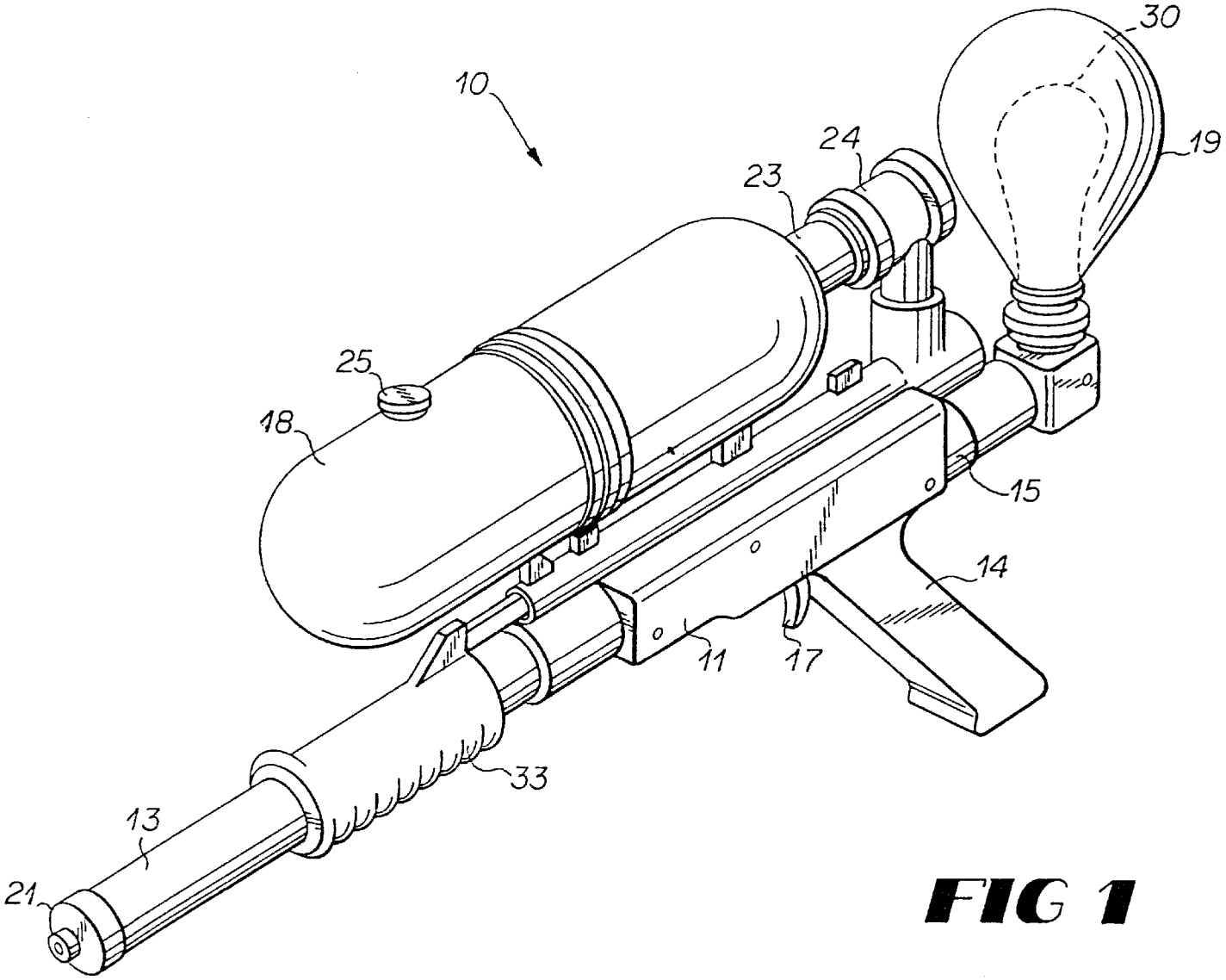
FIG. 1 is a perspective view of a water gun embodying principles of the invention is a preferred form.

With reference next to the drawings, there is shown a water gun 10 having a housing 11 in the shape of a gun with a barrel 13, a handle 14 and a stock 15. The gun 10 has a trigger 17, a removable liquid storage tank or reservoir 18 coupled to the stock 15, an expandable or resilient liquid pressure reservoir or tank 19 mounted to the stock, and a conventional nozzle 21 mounted to the end of the barrel 13. The storage tank 18 has a threaded neck 23 threadably mounted within a threaded receptor 24 within the housing and an opening or port 22 in which is removably mounted a filling cap 25. The receptor 24 has a spring biased check valve or vent 26 which allows air to enter storage tank 18. The pressure tank 19 has a plastic outer shell 29 and an elastic, expandable inner bladder 30 mounted within the outer shell 29 in fluid communication with the storage tank 18. The bladder is preferably made of an elastic material such a rubber. The bladder is shown in phantom lines in FIGS. 1 and 2 in an unpressurized, unexpanded, relaxed configuration and in FIG. 2 in a pressurized, expanded, tensioned configuration in solid lines.

Figures 2, 3:
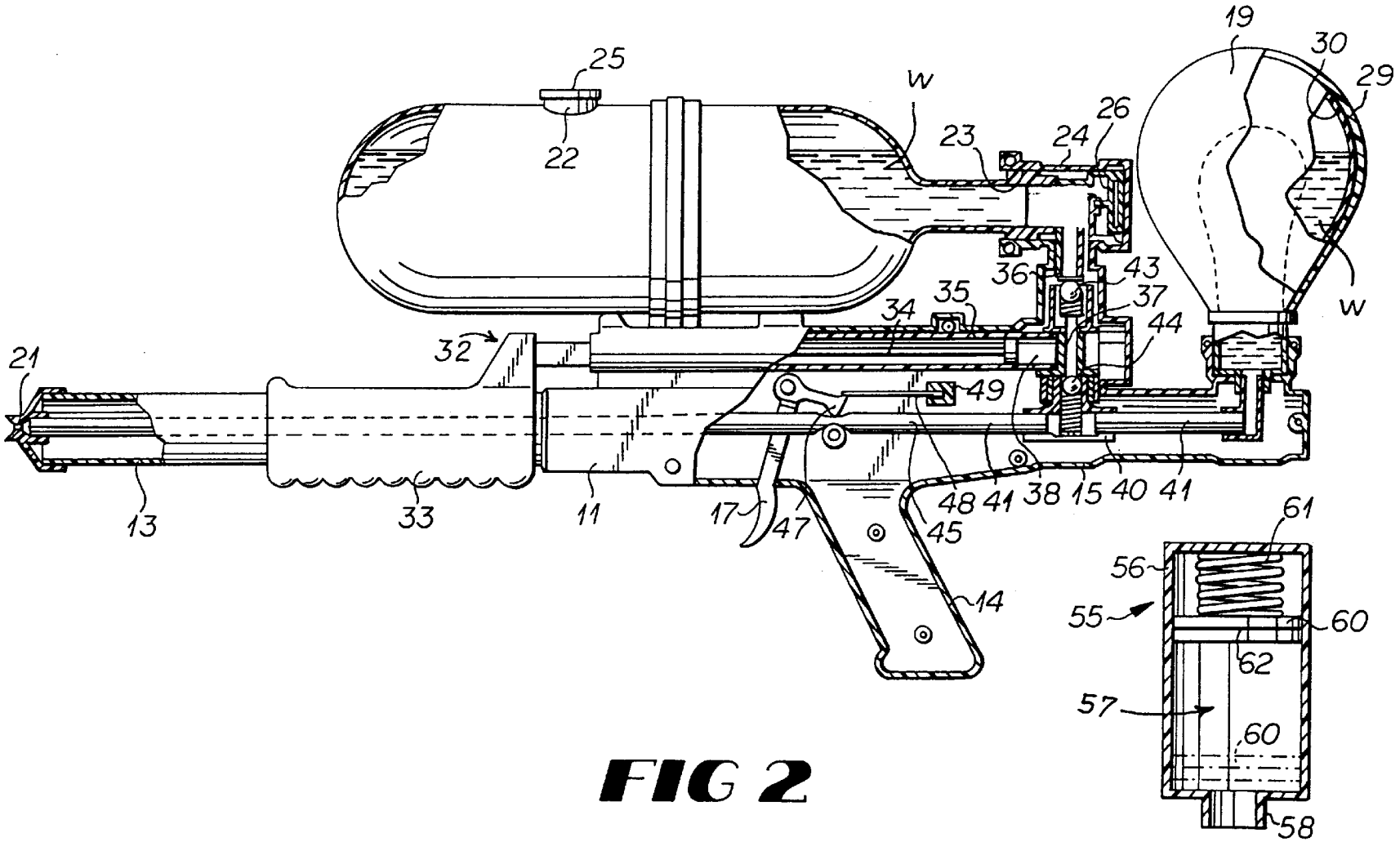
FIG. 2 is a side view, shown in partial cross-section, of the water gun of FIG. 1.
FIG. 3 is a cross-sectional view of an alternative embodiment of the expandable pressure tank of the water gun shown in FIG. 1.

As shown in FIG. 2, the gun 10 has a liquid pump 32 having a handle 33 slidably mounted to barrel 13. The handle 33 is coupled to a piston 34 slidably mounted within a cylinder 35. The cylinder 35 and piston 34 define a chamber 38. A flexible intake tube 36 extends from storage tank 18 to an inlet of pump 32. A flexible outlet tube 37 extends from an outlet of pump 32 to a T-shaped connection 40. A tube 41 extends from the T-shaped connection 40 to pressure tank 19. Intake tube 36 is coupled to a check valve 43 which restricts the flow of liquid to storage tank 18. Similarly, outlet tube 37 is coupled to a check valve 44 which restricts the flow of liquid to pump 32. A flexible delivery tube 45 extends from the T-shaped connection 40 to nozzle 21. A pivotable trigger pinch bar 47 is coupled to trigger 17 and a spring 48. The spring 48 biases pinch bar 47 against delivery tube 45. A stop 49 is positioned against delivery tube 45 opposite pinch bar 47.

In use, the liquid storage tank 18 is filled with a liquid, hereinafter referred specifically to as water W, either by removing it from the stock 15 and filling it through neck 23 or by removing filling cap 25 and pouring water into the tank through opening 22. Should the storage tank be removed for filling it is subsequently threadably remounted to the stock.

The pump handle 33 is then reciprocally moved so as to actuate piston 34 through cylinder 35. The movement of the piston 34 within the cylinder 35 has two-cycle strokes, a priming stroke where water is drawn forth from the storage tank 18, and a compression stroke wherein water is displaced by the piston 34. The priming stroke starts when the piston 34 is retreated within its cylinder 35 to create an elongated volume chamber 38. The vacuum created by the expanding chamber 38 draws water through the intake tube 36 and into chamber 38. The flow of water into the expanding chamber 38 opens check valve 43 that is normally biased in a closed position. Removal of water from the storage tank creates a vacuum within the storage tank which is equalized by air passing through check valve 26.

The compression stroke created by the advancement of the piston 34 within the cylinder 35 causes the water within the chamber 38 to become pressurized. The pressure of the water opens check valve 44 that leads to the elastic bladder 30 of pressure tank 19. As the piston is reciprocated within its cylinder, water is repeatedly drawn from the storage tank and deposited into the elastic bladder 30 through outlet tube 37 and tube 41. As more and more water is drawn and forced into the bladder 30 the bladder expands within outer shell 29 once the water therein exceeds a volume contained within the relaxed bladder. This may occur until the force used to drive the piston can no longer overcome the stored pressures, or the water pressure reaches a preselected pressure level which overcomes the biasing force exerted by pinch bar 47 so as to allow the water to be released through delivery tube 45. The expansion of the elastic bladder 30 creates a force upon the water therein, i.e. the expanded elastic bladder pressurizes the water therein. The pressurized water is prevented from escaping the pressure tank through outlet tube 37 by check valve 44. So long as the elastic bladder 30 is expanded it provides a force upon the water therein.

To release the pressurized water from the gun the trigger 17 is manually pulled to overcome the biasing force exerted by spring 48 upon pinch bar 47. Movement of pinch bar 47 from delivery tube 45 causes the pressurized water within tube 41, delivery tube 45 and pressure tank bladder 30 to be released as a stream from nozzle 21. The bladder contracts with expulsion of water therefrom but maintains a pressure upon the water until the bladder reaches a relaxed configuration. It should also be understood that the water gun may emit a stream of water while simultaneously pumping water through actuation of handle 33.

It should be understood that the outer shell 29 protects the elastic bladder 30 from direct contact which may cause its rupture. Also, the outer shell encases the bladder so as to provide an elastic limit so that the bladder is not overinflated or pressurized beyond its elastic limits. Nevertheless, it should also be understood that the outer shell is not mandatory.

With reference next to FIG. 3, an expandable, elastic pressure tank 55 in another preferred form is shown as an alternative to that shown in FIGS. 1 and 2. It should be understood that the remaining portions of the gun to which tank 55 is mounted are the same as previously described. Here, the pressure tank 55 has a housing 56 defining a chamber 57 and a neck 58 mounted to gun housing 11. The pressure tank 55 also has a plunger 60 movably mounted within chamber 57 and a spring 61 biasing the plunger 60 toward neck 58. The plunger 60 has a O-ring 62 which creates a seal between the plunger 60 and housing 56. The plunger 60 is shown in phantom lines in an unpressurized, expanded position and a pressurized, expanded position in solid lines. Thus, the term "expanded" is meant to describe the increase in fluid capacity within the pressure tank as the plunger is moved therein and not necessarily to the structure of housing 56, i.e. the casing. Similarly, the term "elastic" is meant to describe the changes in the size of chamber 57 as the plunger is moved within the housing.

In use, the pump 32 forces water into chamber 57 through neck 58. As more and more water is forced into chamber 57 the plunger 60 moves upward against the biasing force of the spring 61 from its unexpanded position to its expanded position. The compression force of the spring 61 upon the plunger maintains pressure upon the water within chamber 57 which enables the water to be expelled from the gun. As in the previous embodiment the orientation of the gun has no significant effect on its internal operation.

The expandable pressure tanks as just describe maintain a more constant pressure upon the water therein as compared to pressure tanks of the prior art utilizing compressed air. This is due to the fact that as water is removed from the pressure tank the volume of airspace increases while the quantity of air remains the same. This results in a rapid decrease in air pressure pressurizing the water within the tank.

It should be understood that an electrically motorized pump may be used in place of the manually actuated pump shown in the preferred embodiment.

Figure 4:
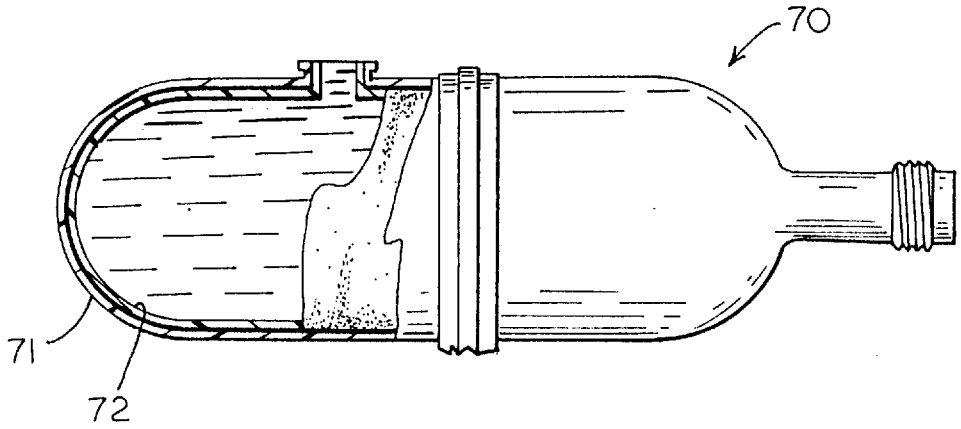
FIG. 4 is a cross-sectional view of an alternative embodiment of the storage tank.

With reference next to FIG. 4, there is shown a liquid storage tank 70 in another preferred form which replaces the previously described storage tank. All other features of the water gun of the same except for the elimination of vent check valve 26. The liquid storage tank 70 has an external shell 71 and a collapsible, flexible, internal liner 72. The internal liner 72 may be elastic or otherwise expandable.

In use, as water is placed within the collapsed liner 72 it expands to accommodate the water in a manner to substantially prevent the creation of a space which may contain air, i.e. without creating an air pocket within the liner. As such, the liquid storage tank 70 contains only water.

In use, as liquid pump 32 is actuated only water is drawn from the liquid storage tank and deposited into the pressure tank 19. As water is drawn from the storage tank collapses until the storage tank is empty of water. Thus, air is prevented from being pumped into the pressure tank to maximize efficiency. As air within the pressure tank decreases the efficiency of the water gun by occupying space within the pressure tank and utilizing the elastic force of the pressure tank in compressing the air rather than in pressurizing the water therein.

It should be understood that as an alternative to the just described storage tank, such could also be made similarly to the pressure tank shown in FIG. 3. Thus, the term collapsible is meant to describe changes in the storage tank capacity or internal volume.

Figure 6:
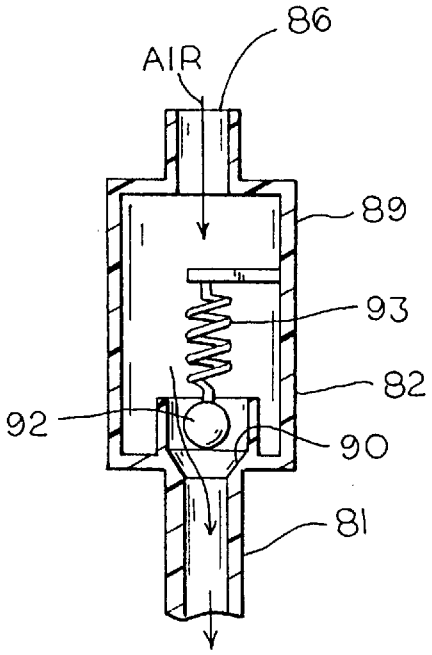
FIG. 6 is a cross sectional view of the check valve of FIG. 5, shown with air therein.
Figure 7:
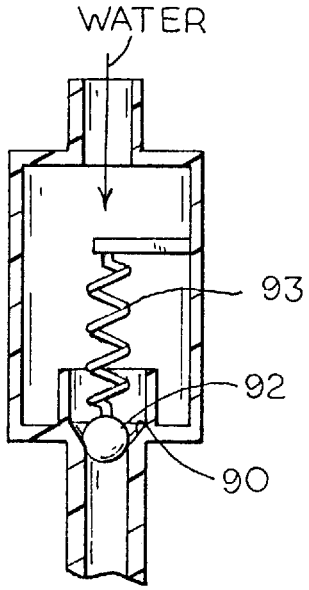
FIG. 7 is a cross-sectional view of the check valve of FIG. 5, shown with water therein.
Figure 5:
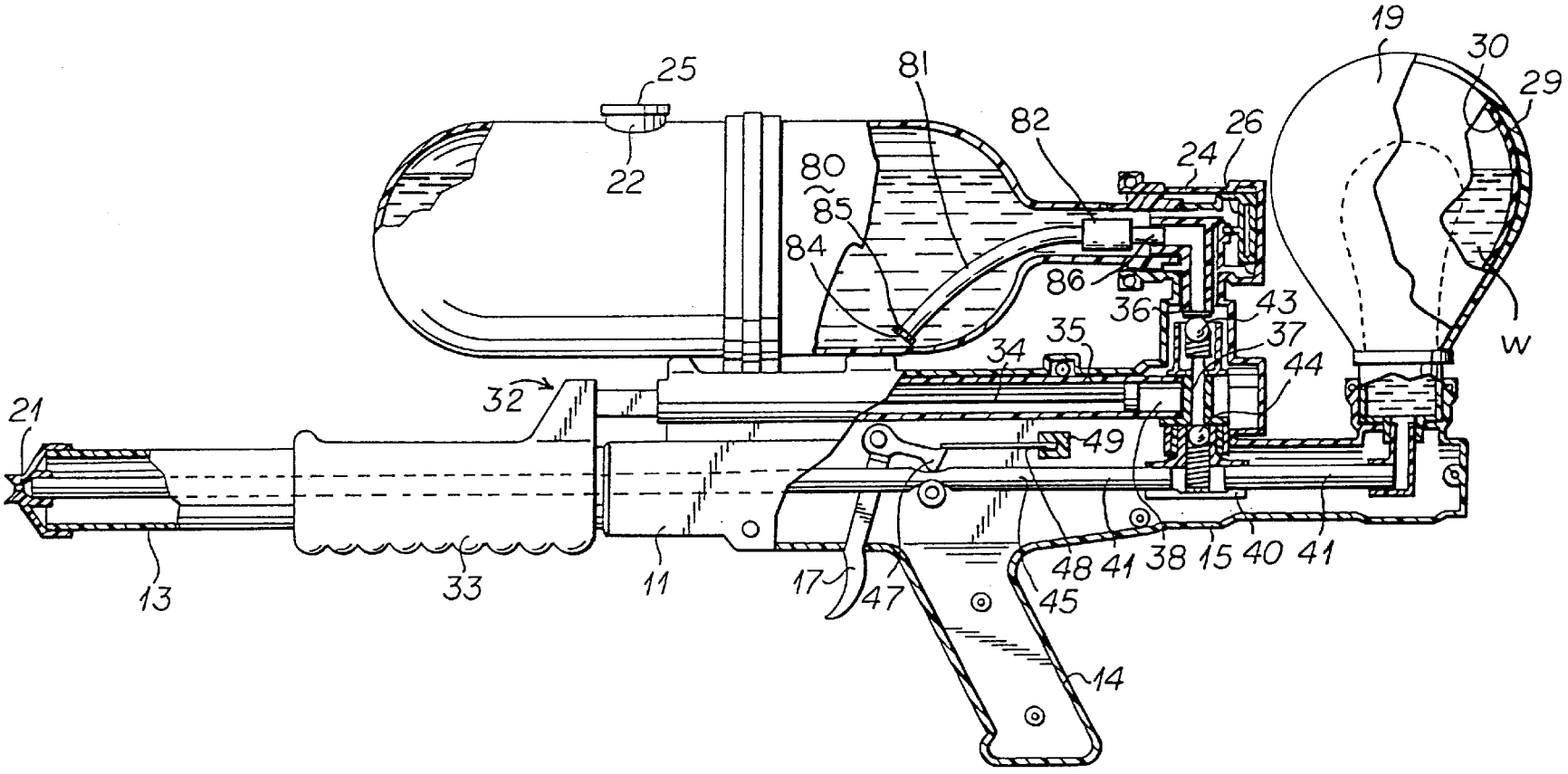
FIG. 5 is a side view of an alternative embodiment of the intake tube and check valve.

Referring next to FIGS. 5–7, there is shown a storage reservoir tank 80 having an elongated, flexible intake tube 81 extending into the storage reservoir 80 and a fluid sensitive check valve 82 in other preferred forms. Here, the intake tube 81 has an intake end 84 with a weight 85 mounted thereon and an outlet end 86 coupled to check valve 82. The check valve 82 has a housing 89 coupled to the outlet end 86 of the intake tube to form an annular seat 90. A ball 92 coupled to a spring 93 is mounted to the housing so as to position the ball 92 adjacent and spaced from seat 90. Ball 92 has a selected hydrodynamic drag sufficient to move the ball against the biasing force of spring 93 into sealing engagement with seat 90, and an aerodynamic drag insufficient to move the ball against the biasing force of the spring, both of which in respect to the fluid dynamics produced by the compression stroke of piston 34 as indicated by the arrows in FIGS. 6 and 7.

In use, the priming stroke of the pump piston 34 causes the water within the storage tank 80 to be drawn up through intake tube 81, into check valve 82 past ball 92, and through outlet tube 37 to the pump. With the compression stroke of the pump piston 34 the water within check valve 82 forces ball 92 into seat 90, thereby preventing the flow of water back to the storage tank 80 and forcing the water within the pump cylinder 35 through check valve 44 and into the pressure tank. Should the storage tank become depleted with water and air is drawn into the check valve 82 through the intake tube by the priming stroke of the pump, the returning compression stroke of the pump piston 34 will cause air to pass about ball 92 and back into storage tank 80 rather than being forced into pressure tank 19. As this path of travel has less resistance than that needed to overcome the compression force needed to open check valve 44 and overcome the high pressure condition behind the check valve, i.e. the air will return through the open avenue to the storage reservoir rather than being forced into pressure tank 19. As such, air is once again prevented from entering the pressure tank and thereby causing inefficiencies with respect to the expulsion of water from the elastic pressure tank.

It should be understood that the intake tube 81 need not extend into the storage tank if the inlet to such extends through the bottom wall of the pressure tank as in many conventional water guns. The weighted, flexible, intake tube merely ensures that water is drawn by the pump, rather than air, regardless of the orientation of the water gun. The main objective is to draw all the water from the storage tank prior to the introduction and rejection of unwanted air. It should also be understood that the storage tank of FIG. 4 may be combined with the intake tube of FIGS. 5–7 to produce a water gun which demonstrates both methods of restricting the introduction of air into the pressure tank.

It thus is seen that a toy water gun in now provided which maintains a more constant pressure upon liquid while being dispensed from the pressure tank in a more efficient manner by restricting the introduction of air within the pressure tank. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A water gun comprising a storage reservoir adapted to expand to a size sufficient to hold a range of liquid quantities and configured to restrict air from being held therein; an expandable pressure tank adapted to hold liquid and to expand under induced tension upon introducing liquid in excess of a selected volume therein and thereby exert a force upon the liquid; a pump for drawing liquid from said storage reservoir and depositing the drawn liquid into said expandable pressure tank; conduit means for conveying liquid from said expandable pressure tank to ambience; and control means for controlling the flow of liquid through said conduit means.

2. The water gun of claim 1 wherein said expandable pressure tank comprises an elastic bladder.

3. The water gun of claim 1 wherein said storage reservoir comprises a collapsible bladder.

4. The water gun of claim 3 wherein said collapsible bladder is elastic.

5. The water gun of claim 2 wherein said expandable pressure tank further comprises a protective shell encasing said elastic bladder.

6. The water gun of claim 1 wherein said storage reservoir comprises a flexible liner and a shell encasing said flexible liner.

7. The water gun of claim 1 wherein said expandable pressure tank has a chamber, a movable plunger mounted within said chamber, and spring biasing means for biasing said plunger in a directing to exert force upon liquid contained within said chamber.

8. The water gun of claim 1 further comprising a check valve for preventing water within said expandable pressure tank from returning to said storage reservoir.

9. A water gun comprising a liquid storage reservoir;

an elastic pressure tank adapted to be expanded and contracted upon changes in the volume of liquid pumped therein;

a pump;

first conduit means for conveying liquid contained within said storage reservoir to said pump, said first conduit means including fluid sensitive check valve means for restricting the flow of liquids from said pump to said liquid storage reservoir and allowing the flow of gases from said pump to said liquid storage reservoir upon actuation of said pump;

second conduit means for conveying liquid from said pump to said elastic pressure tank, said second conduit means including second check valve means for preventing the flow of liquids from said pressure tank to said pump;

third conduit means for conveying liquid from said elastic pressure tank to ambience; and control means for controlling the flow of liquid through said third conduit means, whereby liquid within the storage reservoir is pumped into the elastic pressure tank through the first and second conduits thereby forcing the elastic pressure tank to its second configuration so as to pressurize liquid therein which is controllably released from the elastic pressure tank through the third conduit means by actuation of the control means, and whereby the air within the storage reservoir is prevented from being pumped into the pressure tank by the operation of the fluid sensitive check valve means.

10. The water gun of claim 9 wherein said elastic pressure tank comprises an elastic bladder.

11. The water gun of claim 9 wherein said fluid sensitive check valve means comprises an annular seat through which liquids flow, a restrictor configured to be received within said seat, biasing means for biasing said restrictor in a direction away from said seat, and wherein said restrictor has a hydrodynamic drag sufficient to move said restrictor against the biasing force of said biasing means and an aerodynamic drag insufficient to move said restrictor against the biasing force of said biasing means.

12. The water gun of claim 10 elastic pressure tank further comprises a protective shell encasing said elastic bladder.

13. The water gun of claim 9 wherein said elastic pressure tank has a chamber, a movable plunger mounted within said chamber, and spring biasing means for biasing said plunger in a directing to exert force upon liquid contained within said chamber.

14. The water gun of claim 9 further comprising a limiting means for limiting pressure within said elastic pressure tank.

15. The water gun of claim 9 further comprising a check valve for preventing water within said elastic pressure tank from returning to said storage reservoir.

16. A water gun comprising a storage reservoir; elastic pressure tank means for exerting pressure on a body of liquid therein; means for preventing the flow of air from said storage reservoir to said pressure tank; means for drawing liquid from said storage reservoir and depositing the drawn liquid into said elastic pressure tank means; conduit means for conveying liquid from said elastic pressure tank means to ambience; and control means for controlling the flow of liquid through said conduit means.

17. The water gun of claim 16 wherein said preventing means comprises the storage reservoir being formed of a flexible and collapsible material.

18. The water gun of claim 16 wherein said preventing means comprises fluid sensitive check valve means for restricting the flow of liquids from said pump to said liquid storage reservoir and allowing the flow of gases from said pump to said liquid storage reservoir, whereby actuation of the pump forces only liquids into said pressure tank means.

19. The water gun of claim 18 wherein said fluid sensitive check valve means comprises an annular seat through which liquids flow, a restrictor configured to be received within said seat, biasing means for biasing said restrictor in a direction away from said seat, and wherein said restrictor has a hydrodynamic drag sufficient to move said restrictor against the biasing force of said biasing means and an aerodynamic drag insufficient to move said restrictor against the biasing force of said biasing means.

20. The water gun of claim 16 wherein said elastic pressure tank means comprises an elastic bladder.

21. The water gun of claim 20 elastic pressure tank means further comprises a protective shell encasing said elastic bladder.

22. The water gun of claim 16 wherein said elastic pressure tank means has a chamber, a movable plunger mounted within said chamber, and spring biasing means for biasing said plunger in a directing to exert force upon liquid contained within said chamber.

* * * * *